US005335430A

United States Patent [19]

Fiso et al.

[11] Patent Number: 5,335,430

[45] Date of Patent: Aug. 9, 1994

[54] INFLATABLE ATHLETIC SHOE WITH DETACHABLE PUMP

[76] Inventors: Joseph F. Fiso, 4030 California Ave., S.W.; Tae S. Lee, P.O. Box 16783, both of Seattle, Wash. 98116

[21] Appl. No.: 14,272

[22] Filed: Feb. 5, 1993

[51] Int. Cl.[5] ..... A43B 7/14; A43B 13/20; A43B 23/00

[52] U.S. Cl. ..... 36/88; 36/54; 36/29; 36/136

[58] Field of Search ..... 36/114, 93, 3 B, 3 R, 36/88, 89, 28, 29, 132, 136, 54, 56

[56] References Cited

U.S. PATENT DOCUMENTS

| | | | |
|---|---|---|---|
| 3,760,056 | 9/1973 | Rudy | 36/93 X |
| 4,397,104 | 8/1983 | Doak | 36/3 B X |
| 4,712,316 | 12/1987 | Baggio | 36/93 X |
| 4,730,403 | 3/1988 | Walkhoff | 36/93 X |
| 5,113,599 | 5/1992 | Cohen et al. | 36/88 |

FOREIGN PATENT DOCUMENTS

| | | |
|---|---|---|
| 3427644 | 1/1986 | Fed. Rep. of Germany . |
| 8910074 | 11/1989 | PCT Int'l Appl. . |
| 9110376 | 7/1991 | PCT Int'l Appl. . |

*Primary Examiner*—Paul T. Sewell
*Assistant Examiner*—BethAnne Cicconi
*Attorney, Agent, or Firm*—Richard C. Litman

[57] ABSTRACT

An athletic shoe has two independent, inflatable chambers, one in the sole and one partially forming the shoe upper. The former chamber cushions impacts and displaces solid material from which the sole would otherwise comprise, and the second tightens the fit of the shoe on a wearer's foot. Each chamber has independent inflation and outlet valves. Resilient pilings distribute a wearer's weight over the sole, protecting the first chamber from deformation during activity. A pump is detachably mounted on the shoe tongue. The pump has a ring for attachment to a key ring as an alternative to being secured on the shoe tongue when not in use. A preferred inflation medium is helium.

8 Claims, 3 Drawing Sheets

INFLATABLE ATHLETIC SHOE WITH DETACHABLE PUMP

BACKGROUND OF THE INVENTION

1. Field of the Invention

The present invention relates to shoes having built in inflatable members for cushioning and gripping the foot.

2. Description of the Prior Art

Provision of a fluid chamber in a shoe to cushion and grip the foot is well known. The fluid may be liquid or gas, and the chamber may be located in the sole or in the upper. German Pat. Document No. DE 3427644 A1, dated Jan. 1, 1986, discloses an inflatable member disposed about the upper of a ski boot or the like. A hatch is movable to uncover a pump and valve.

PCT international Application No. WO 89/10074, published on Nov. 2, 1989, discloses a shoe having a reservoir containing an incompressible fluid located in the sole of the shoe.

PCT International Application No. WO 91/10376, published on Jul. 25, 1991, discloses a shoe having a reservoir containing a fluid located in the sole, and communicating with at least one additional reservoir extending above the sole. When pressure in the first reservoir increases, that pressure acts on the additional reservoir to cause pressure to be exerted on that part of the shoe above the sole. This latter pressure improves grip of the shoe on the wearer's foot.

U.S. Pat. No. 4,397,104, issued to Clayton R. Doak on Aug. 9, 1983, discloses a shoe having an inflatable sole. Resilient members provide pilings supporting the weight of the wearer so as not to collapse an inflated chamber in the sole.

U.S. Pat. No. 4,999,932, issued to Tracy E. Grim on Mar. 19, 1991, discloses an inflatable shoe having plural bladders. However, the bladders are in fluid communication with one another.

U.S. Pat. No. 4,995,173, issued to I. Martin Spier on Feb. 26, 1991, illustrates basic pneumatic components used with inflatable shoes, including a bellows type pump; one way valves, an inflatable bladder, a pressure regulating valve, and a manual release valve.

U.S. Pat. No. 5,074,765, issued to Robert W. Pekar, describes typical construction techniques usable to fabricate pneumatic systems, as for shoes.

U.S. Pat. No. 5,113,599, issued to Eric D. Cohen et al. on May 19, 1992, discloses an inflatable shoe having layers of foam material.

None of the above inventions and patents, taken either singly or in combination, is seen to describe the instant invention as claimed.

SUMMARY OF THE INVENTION

The novel inflatable shoe includes two independent, inflatable chambers, the first being formed in the sole, and the second being formed in the shoe upper body portion (hereinafter, the shoe upper body portion will be referred to as the upper, and the member including the inflatable chamber formed in the upper will be referred to as an air sock). The former chamber cushions the wearer's foot, as well as displacing solid material from the sole and thereby reducing weight, and the air sock increases grip of the upper on the wearer's foot. Resilient members spaced throughout the chamber in the sole resist deformation of the sole and its associated chamber upon vigorous activity.

Each chamber has its own inflation and outlet valves. Thus, grip of the air sock is adjustable independently of adjustable pressure provided in the chamber in the sole.

A pump detachably connects to inflation valves at the back of the shoe. The pump has a convex upper surface defining a groove therein for mounting to the tongue of the shoe when not being used. The tongue has a cooperating band engaging this groove. As an alternative to mounting to the tongue, the pump is provided with an attachment ring, enabling attachment to a key ring or other similar device.

While any gas could be used to inflate the novel shoe, helium is a preferred inflation medium, since, in addition to being inert and lighter than air, it conducts less heat than other gasses. This property is advantageous in shoes used for winter sports.

Accordingly, it is a principal object of the invention to provide an inflatable shoe having two independent inflated chambers.

A second object of the invention is to provide an inflatable member located in the upper of the shoe.

It is another object of the invention to provide an inflatable chamber in the sole of the shoe.

It is yet another object of the invention to construct an inflatable shoe so as to resist deformation of the sole and its associated inflatable chamber during vigorous use.

It is a further object of the invention to provide each of at least two inflatable chambers or members with independent inflation and outlet valves.

Yet a further object of the invention is to provide an inflatable shoe having inflation valves which are accessible from the exterior of the shoe.

Still another object of the invention is to provide an inflatable shoe having a removable pump.

A further object of the invention is to provide an inflatable shoe having means to retain a removable pump thereon when the pump is not in use.

An additional object of the invention is to provide an inflatable shoe having an attachment ring thereon, thus enabling attachment to other objects when not in use.

Yet another object of the invention is to provide an inflation medium which is of low density and has low heat conductivity properties.

It is an object of the invent ion to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
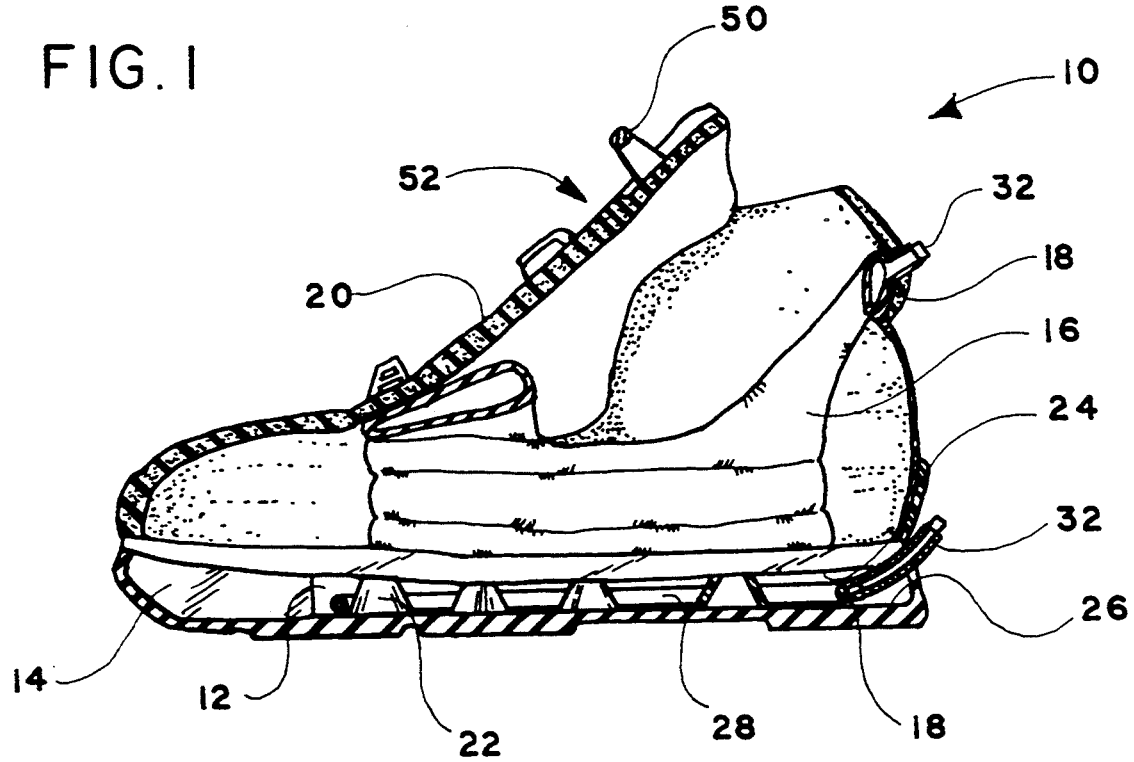
FIG. 1 is a side elevational view of the invention, partly broken away to reveal internal detail.

With reference to FIG. 1, the inflatable shoe 10 of the present invention has two independent, inflatable members. One inflatable member comprises a chamber 12 defined in the sole 14, and the second inflatable member being an air sock 16. Each inflatable member has an inflation valve 18 and an outlet valve (not shown) of well known type. Illustratively, a single one-way valve, spring biased into a closed orientation, and similar to valves commonly used to inflate pneumatic tires, may be used. In this example, the inflation valve 18 and outlet valve are both provided in a unitary assembly. Inflation valves 18,18 are shown in their preferred locations on the shoe 10; outlet valves (not shown if separate from inflation valves) are preferably inconspicuously placed, and specific location is not of interest here. Inflation and outlet valves may incorporate pressure responsive or bleed-down characteristics, if desired. As pneumatic valves suitable for inflation and outlet valves are well known, as evidenced in the prior art discussed above, specific construction thereof will not be discussed further.

Figure 2:
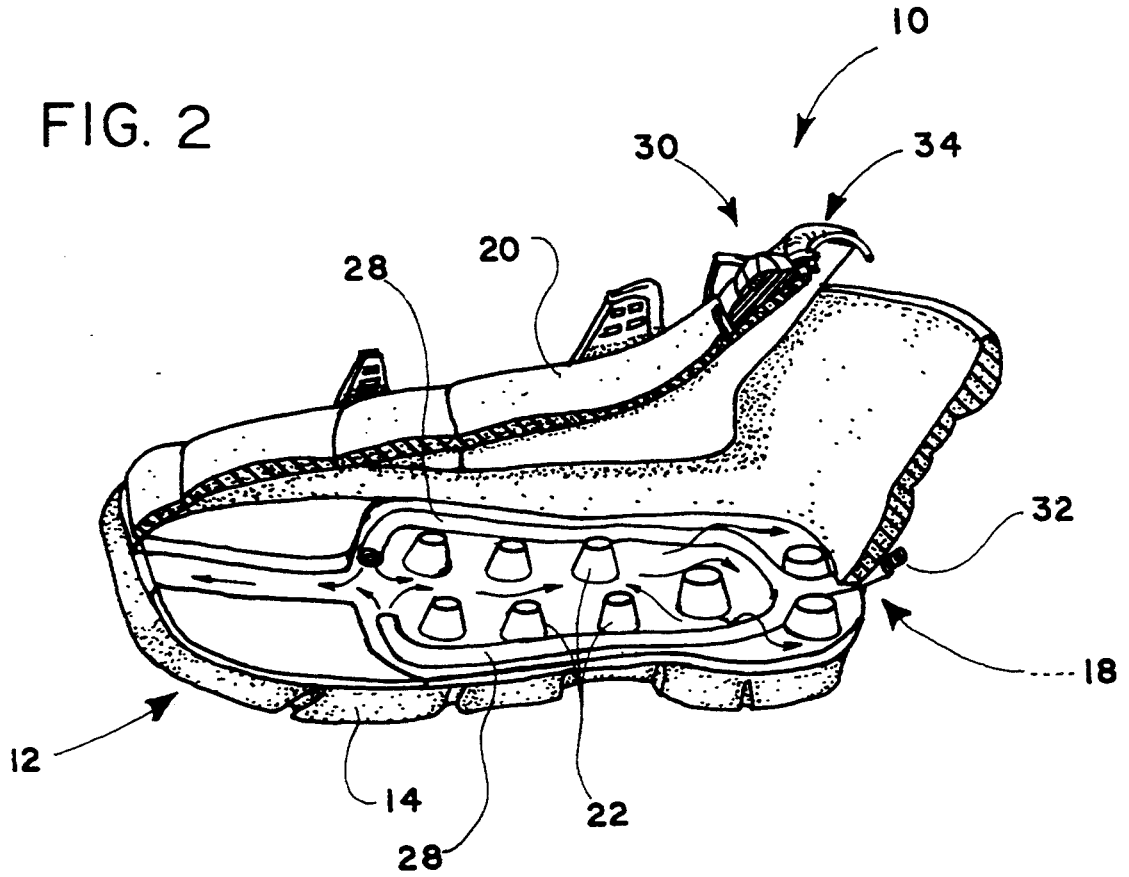
FIG. 2 is a perspective view of the invention, partly broken away to reveal internal detail.

Better seen in FIG. 2, the chamber 12 in the sole 14 extends substantially over the area of the sole of a wearer's foot (not shown). As the shoe upper 20 cannot be depended upon to prevent deformation of the shoe 10 during vigorous activity, as might occur when running or when engaging in any maneuver in which direction or momentum is abruptly changed, resilient members 22 are provided to secure two benefits. Resilient members 22 both support the roof 24 of chamber 12, distributing the wearer's weight evenly over the floor 26 of chamber 12, and substantially maintain roof 24 and floor 26 in parallel and overlying relation, while accommodating a small degree of squirm.

Chamber 12 is made as large as is practical. Because of pneumatic support of the wearer's weight, the amount of solid matter used to construct the shoe 10 can be minimized, which in turn minimizes total weight of the shoe 10.

Inlet tubes 28 distribute the inflation medium advantageously throughout chamber 12.

Figure 3:
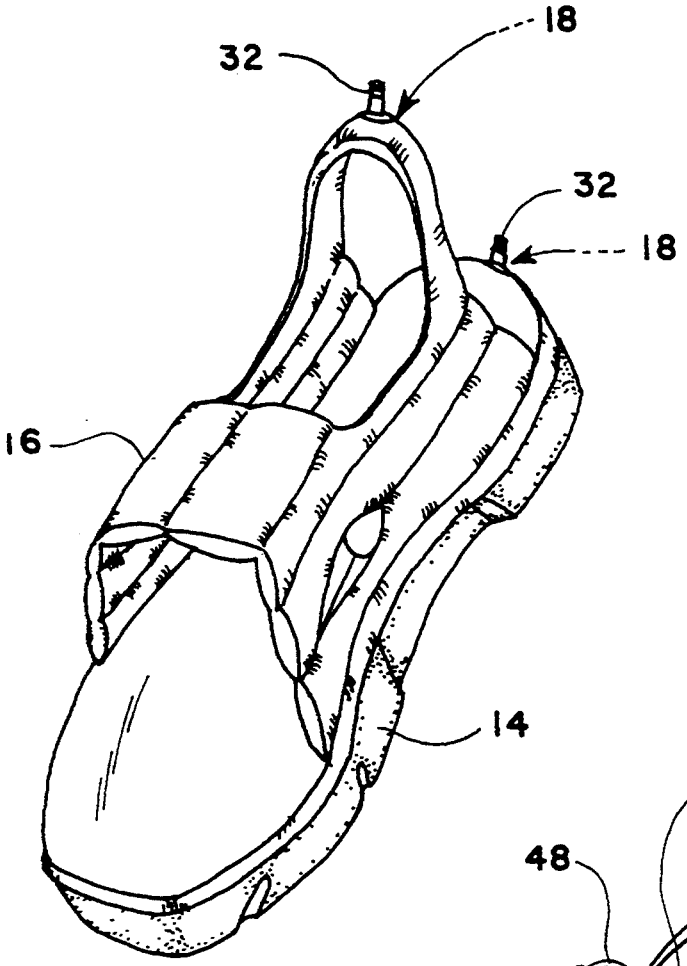
FIG. 3 is a perspective detail view of the novel shoe, showing the sole and air sock.

Turning now to FIG. 3, the shoe tongue 30 and upper 20 being omitted for clarity in this view, the air sock 16 is seen partially but effectively to surround the wearer's foot, allowing for protrusion of toes, heel and ankle (none shown). This degree of containment of the foot leads to satisfactory grip by shoe 10 when the air sock 16 is inflated, while permitting the foot a reasonable amount of area for airflow. The view of FIG. 3 further clarifies preferred locations of inflation valve extensions An advantage afforded by valves accessible from the exterior of the shoe 10 rather than pumps integral with the shoe 10 is that inflation may be accomplished by any of several desired fluid sources. For example, either a pump 34 (to be discussed hereinafter), or a prepressurized cannister (of well known type, and thus not shown) may be used as a fluid source.

Figure 7:
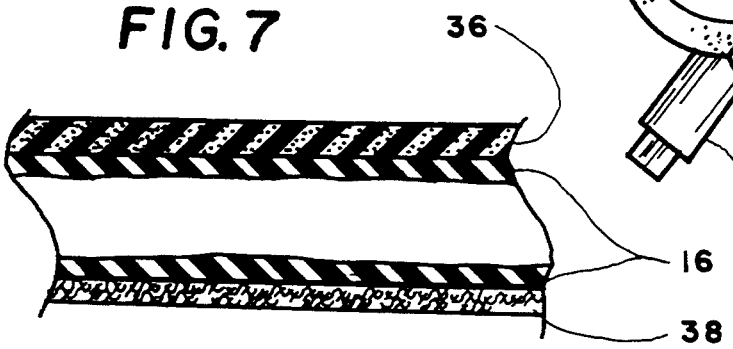
FIG. 7 is a cross sectional detail view of the upper of the novel shoe, drawn to enlarged scale.

Preferably, the air sock 16 is concealed beneath an outer ornamental upper covering 36, as seen in FIG. 7. Since it will be made from a gas impervious material, aeration of the adjacent portions of the foot is enabled by a layer of foam material 38 located on the inside of air sock 16, against the wearer's foot.

If helium is selected as the inflation medium, then the air sock 16 and chamber 12 formed in the sole 14 would be lined with a material (not shown) selected to be resistant to osmotic loss of helium.

Figure 4:
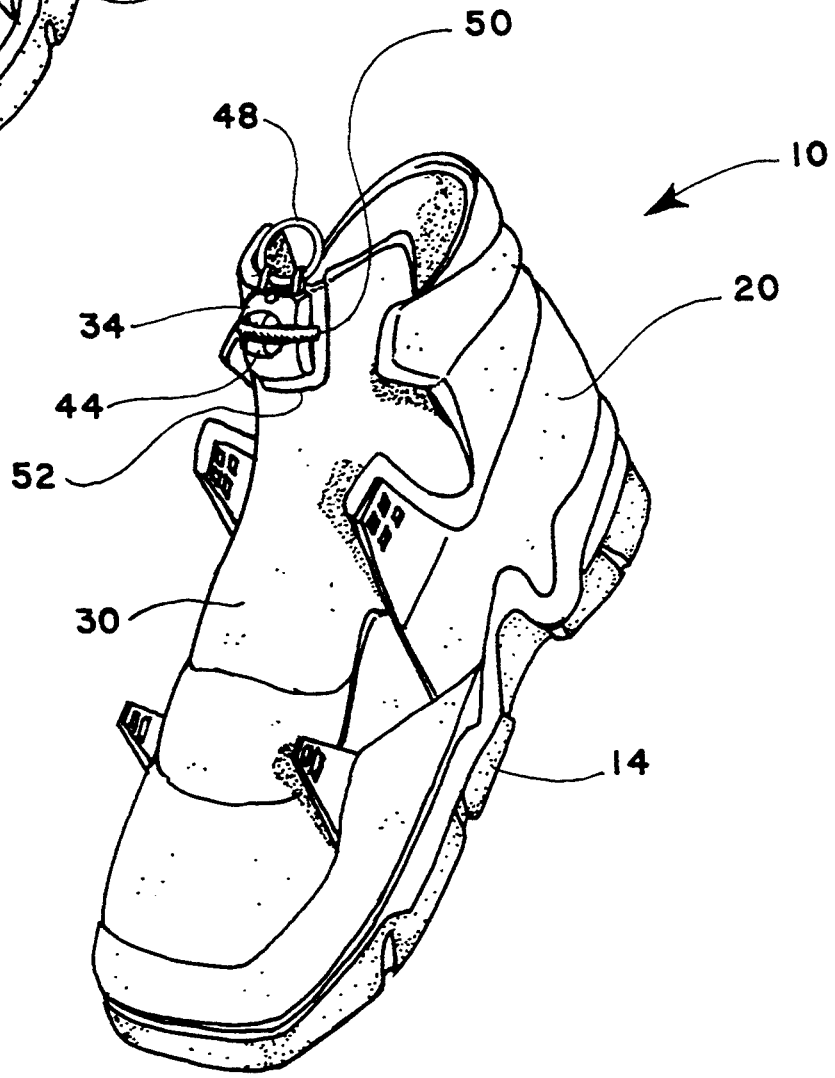
FIG. 4 is a perspective view of the novel shoe, particularly illustrating the pump, as fastened to the shoe.
Figure 5:
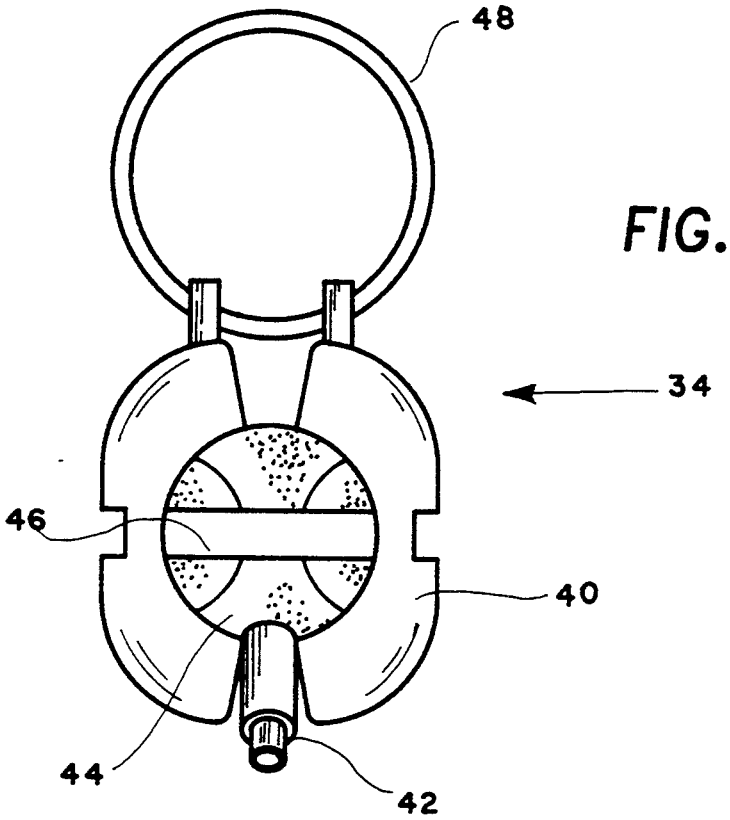
FIGS. 5 and 6 are, respectively, a top plan view of the pump, and a side elevational view of the pump, both drawn to enlarged scale.
Figure 6:
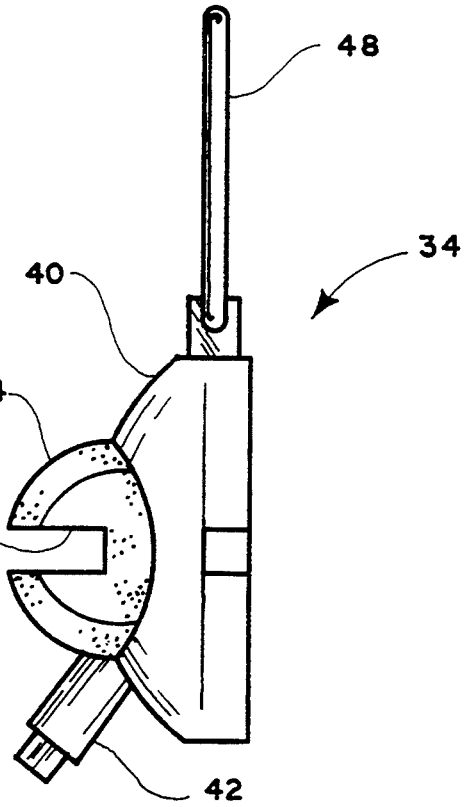

A preferred pump 34 is illustrated in FIGS. 5 and 6. Pump 34 comprises an expansible body 40 operating in the manner of a bellows assembly, a delivery nozzle 42 which cooperates with a valve extension 32 to accomplish pressure tight connection therebetween in well known fashion, a convex member 44 having a transverse groove 46, and an attachment ring 48. The convex member 44 enables the pump 34 to be maneuvered to engage a retention band 50 formed in a member 52 secured to the tongue 30 (see FIG. 4). This band 50 is flexible, and seats in the groove 46, thus securing the pump 34 to the shoe 10 for storage when the pump 34 is not in use. The pump 34 is securely held, but flexibility and resilience of the shoe 10, band 50, and pump 34 combine to enable the pump 34 to be easily removed when desired. The pump 34 is made from a resilient material, such as rubber, and the member 52 secured to the tongue 30 is made from a mildly resilient material, such as plastic.

If the wearer considers the pump 34 to be cumbersome or unsightly, or wishes to maintain the pump 34 more accessible, attachment ring 48 enables the pump 34 to be releasably connected to another object (not shown), such as a key ring.

It is to be understood that the present invention is not limited to the sole embodiment described above, but encompasses any and all embodiments within the scope of the following claims.

We claim:

1. An inflatable shoe comprising a sole, an upper and a tongue, said shoe having a rear, means defining a plurality of independent inflatable chambers for being inflated with an inflation medium, including at least a first chamber located in said sole and at least one subsequent chamber located in an air sock forming part of said upper, said first chamber having first inflation valve means including first access means disposed at and exteriorly of said rear of said shoe, and first outlet valve means extending exteriorly of said shoe, said air sock having second inflation valve means including second access means disposed at and extending exteriorly of said rear of said shoe, and second outlet valve means extending exteriorly of said shoe, said first and second inflation valve means having means detachably attachable to a source of pressurized fluid, whereby said shoe fluid chambers are capable of being pressurized by a pump and by a prepressurized cannister, a cooperating detachably mounted pump including means defining a groove for engaging a tether, and means for releasably retaining said pump mounted on said tongue, comprising tether means for interfitting with and partial surrounding said groove of said pump.

2. The inflatable shoe according to claim 1, said means for retaining said pump comprising an arcuate band, said pump means defining a groove further having a convex surface, whereby said pump is slid under and into interfitting engagement with said arcuate band.

3. The inflatable shoe according to claim 1, said first chamber further comprising a roof, a floor, and resilient support members extending between said roof and said floor, whereby weight of a wearer is distributed evenly over said chamber floor, and said chamber configuration is maintained.

4. The inflatable shoe according to claim 1, further comprising an inflation medium, said inflation medium being helium.

5. The inflatable shoe according to claim 2, said first chamber further comprising a roof, a floor, and resilient support members extending between said roof and said floor, whereby weight of a wearer is distributed evenly over said chamber floor, and said chamber configuration is maintained.

6. The inflatable shoe according to claim 2, further comprising an inflation medium, said inflation medium being helium.

7. The inflatable shoe according to claim 1, said pump comprising an attachment ring, whereby said pump is retained on a key ring as an alternative to being secured on said tongue when not in use.

8. The inflatable shoe according to claim 3, further comprising an inflation medium, said inflation medium being helium.

* * * * *